US008311241B1

(12) United States Patent
Jordahl

(10) Patent No.: US 8,311,241 B1
(45) Date of Patent: Nov. 13, 2012

(54) MICROPHONE CIRCUIT

(75) Inventor: David Martin Jordahl, Estacada, OR (US)

(73) Assignee: Lightspeed Technologies, Inc., Tualatin, OR (US)

( * ) Notice: Subject to any disclaimer, the term of this patent is extended or adjusted under 35 U.S.C. 154(b) by 1564 days.

(21) Appl. No.: 11/809,431

(22) Filed: May 31, 2007

(51) Int. Cl.
*H04R 3/00* (2006.01)

(52) U.S. Cl. ..... 381/113; 381/111; 381/122; 381/123; 330/297; 330/271

(58) Field of Classification Search ..... 359/237; 381/172, 11–113, 122–123; 398/23, 182; 455/91, 127.1, 127.5
See application file for complete search history.

(56) References Cited

U.S. PATENT DOCUMENTS 4,221,932 A * 9/1980 Anglikowski et al. ..... 379/56.3
4,543,665 A * 9/1985 Sotelo et al. ..... 379/56.3
4,882,770 A * 11/1989 Miyahira et al. ..... 398/76
4,959,828 A * 9/1990 Austin ..... 398/103
5,087,982 A * 2/1992 Smothers ..... 398/118
5,359,448 A 10/1994 Laszlo et al.
5,548,654 A 8/1996 Fast
5,596,648 A 1/1997 Fast
5,818,328 A 10/1998 Anderson et al.
5,881,156 A * 3/1999 Treni et al. ..... 381/91
6,421,426 B1 * 7/2002 Lucey ..... 379/56.3
6,525,854 B1 * 2/2003 Takahashi et al. ..... 398/115
6,754,451 B1 * 6/2004 Nakamura ..... 398/135
6,893,346 B2 * 5/2005 Small et al. ..... 463/40
6,944,483 B1 * 9/2005 Motohashi ..... 455/574
2003/0036413 A1 * 2/2003 Ylo ..... 455/569
2005/0232447 A1 * 10/2005 Shinozuka et al. ..... 381/122
2006/0083392 A1 * 4/2006 Akino ..... 381/122

OTHER PUBLICATIONS

Linear Technology, White LEF Driver and Boost Converter in 3mm x 3mm DFN Package, pp. 1-20 (2005).

* cited by examiner

*Primary Examiner* — Disler Paul
(74) *Attorney, Agent, or Firm* — Klarquist Sparkman, LLP

(57) ABSTRACT

An infrared light emitting diode circuit and related methods are disclosed. Exemplary features of embodiments comprise circuitry for controlling the voltage delivered to infrared light emitting diodes and for reducing the power consumption of the circuitry in the absence of audio signals to be transmitted.

20 Claims, 2 Drawing Sheets

MICROPHONE CIRCUIT

TECHNICAL FIELD

The technology disclosed herein relates to microphone circuits and related methods for transmitting infrared light in response to frequency modulated signals, the frequency modulated signals corresponding to audio signals received by a microphone.

BACKGROUND

One prior art infrared microphone (a model LT 71) has been provided by Lightspeed Technologies, Inc., for uses, such as in a classroom. Microphones in accordance with this prior art have circuitry that convert a presenter's voice into infrared signal representations thereof and transmits these infrared signals to an infrared receiver. In this known microphone, the microphone is portable and can be worn by the user, such as hung by a cord from the user's neck. Plural LT 71 microphones can be used in the same classroom with each being adjusted to transmit its infrared signals using a different carrier frequency. Modulation of infrared signals is done in the LT 71 with a frequency modulated current source driving one or more LEDs connected either in parallel or in series to a fixed voltage source. This prior art LT 71 microphone runs off of battery power (two double A batteries). Efficiencies of operation are desirable in order to extend battery life and/or to reduce the size and weight of batteries for a given operational time.

A need exists for improved microphone circuitry and related methods for an infrared microphone transmission system.

SUMMARY

In accordance with one aspect of the technology disclosed herein, the voltage utilized to drive infrared light emitting diodes in response to a frequency modulation signal is variable. Desirably, the drive voltage is varied to match the voltage drop of particular infrared light emitting diodes utilized in a diode circuit and the drive requirements of a diode driver circuit used to frequency modulate the infrared light emitted by the diode circuit. Since the voltage drop across infrared light emitting diodes can vary with current and with different light emitting diodes, the use of a variable voltage source eliminates the need to set a fixed voltage source high enough to accommodate worst case voltage infrared light emitting diode drive voltage levels.

As yet another aspect of the disclosed technology, to extend battery life, current flow through the infrared light emitting diode circuitry and related drive circuitry can be reduced during at least portions of the time that audio signals for transmission are not being received by the microphone of the microphone circuitry.

In accordance with aspects of an exemplary embodiment, a microphone circuit is described for transmitting infrared light in response to frequency modulated signals, the frequency modulated signals corresponding to audio signals received by a microphone coupled to the microphone circuit. The microphone circuit can comprise: a current flow path comprising an infrared diode circuit comprising at least two infrared light emitting diodes; the current flow path can also comprise a switch responsive to the frequency modulated signals to control the flow of current through the current flow path in response to the frequency modulated signals to thereby control the flow of current through the infrared diode circuit and the emission of infrared light from the infrared diodes so as to correspond to the audio signals; the current flow path further can comprise a resistance circuit comprising at least one resistor; a voltage source coupled to the infrared diode circuit; and a voltage regulator operable to vary the voltage of the voltage source so as to maintain a substantially constant current through the resistance circuit during at least a portion of the time that infrared light is emitted from the infrared diodes of the infrared diode circuit.

In accordance with a further aspect of an embodiment, the infrared diode circuit can comprise at least a first diode set comprising first and second infrared light emitting diodes coupled together in series and between the voltage source and the switch. The infrared diode circuit in accordance with yet another embodiment can also comprise at least a second diode set comprising at least third and fourth infrared light emitting diodes coupled together in series and between the voltage source and switch, the first diode set being in parallel with the second diode set, the outputs of the first and third diodes being interconnected, and the outputs of the second and fourth diodes being interconnected.

As a further aspect of embodiments, the resistance of the resistor circuit can be responsive to a power save signal, the resistance of the resistance circuit being at first magnitude or value in response to a power save signal of a first value, the resistance of the resistance circuit being of a second magnitude or value that is higher than the first magnitude in response to a power save signal of a second value different from the first value. The power save signal can be at the second value at least during portions of the time, and more desirably during the entire time, that audio signals are not being received by the microphone for transmission. As a more specific example of this aspect, the resistance circuit can comprise at least a first resistor and a second resistor and can further comprise a resistance adjusting switch responsive to the power save signal. The resistance adjusting switch can be a transistor switch and can be operable to couple the second resistor of the resistance circuit in parallel with the first resistor of the resistance circuit to thereby reduce the magnitude of the resistance of the resistance circuit when the power save signal is at the first level. The resistance adjusting switch can also be operable to decouple the second resistor from being in parallel with the first resistor so as to increase the magnitude of the resistance of the resistance circuit when the power save signal is at the second level.

In accordance with other aspects, an embodiment of a microphone circuit for transmitting infrared light in response to frequency modulated signals, the frequency modulated signals corresponding to audio signals received by a microphone coupled to the microphone circuit, is described wherein the microphone circuit can comprise: an infrared diode circuit comprising a diode circuit input and a diode circuit output and at least two infrared light emitting diodes coupled together and positioned in a diode circuit current flow path between the diode circuit input and diode circuit output, the infrared light emitting diodes emitting infrared light in response to current flowing in the diode circuit current flow path; an adjustable voltage source coupled to the diode circuit input; a switch circuit comprising a switch input coupled to the diode circuit output and a switch output, the switch circuit also comprising a switch in a switch current flow path between the switch input and switch output, the switch comprising a control input for receiving the frequency modulated signals to control the flow of current through the switch current flow path in response to the frequency modulated signals to thereby control the flow of current through the diode current flow path and the emission of infrared light from the infrared light emitting diodes to correspond to the audio signals; a voltage control circuit operable to adjust the voltage of the voltage source so as to maintain the voltage at the diode circuit output at a first level as the switch operates; and a resistance circuit comprising a resistor circuit current flow path from the switch output to electrical ground potential and at least one resistor in the resistor circuit current flow path.

As a more specific aspect, the infrared light emitting diodes can comprise first and second infrared light emitting diodes in series with one another. As a further more specific example, the infrared light emitting diodes can comprise at least a first diode set of at least first and second infrared light emitting diodes in series with one another and a second diode set of at least third and fourth light emitting infrared diodes in series with one another, the diodes of the first diode set being in parallel with the diodes of the second diode set.

As a further aspect of an embodiment, the resistance of the resistance circuit can be adjustable in response to the presence of audio signals to the transmitted.

As yet another aspect of an embodiment, the resistance of the resistance circuit can be responsive to a power save signal with the resistance of the resistance circuit being of a first value or magnitude in response to power save signal of a first value, the resistance of the resistance circuit being of a second value or magnitude which is higher than the first value when the power save signal is at a second value different from the first value, the power save signal being set at the second value at last during portions of the time that audio signals are not being received by the microphone for transmission. The resistance circuit can, for example, comprise at least two resistors with at least one of the two resistors being selectively coupled to the resistor current flow path to vary the resistance of the resistance circuit in response to the power save signal. As a more specific example, the resistance circuit can comprise at least a first resistor and a second resistor and further can comprise a resistance adjusting switch, such as a transistor switch, responsive to the power save signal. The resistance adjusting switch can be operable, in this example, to couple the second resistor of the resistance circuit in parallel with the first resistor of the resistance circuit to thereby reduce the magnitude of the resistance of the resistance circuit when the power save signal is at the first level. The resistance adjusting switch can also be operable in this example to decouple the second resistor from being in parallel with the first resistor so as to increase the magnitude of the resistance of the resistance circuit when the power save signal is at the second level.

As yet another aspect of the disclosure, a method of transmitting infrared light in response to frequency modulated signals corresponding to audio signals received by a microphone is described. An embodiment of the method can comprise: selectively passing current through infrared light emitting diodes so as to cause the infrared light emitting diodes to emit infrared light in response to current flowing through the diodes; operating a switch in response to frequency modulated signals to control the flow of current through the switch and through the infrared diodes to thereby control the emission of the infrared light from the infrared light emitting diodes to correspond to audio signals received by the microphone; passing current from the switch through a resistor network comprising at least one resistor; and regulating the voltage applied to the diodes to maintain a substantially constant current through the resistor network during at least a portion of the time that the infrared diodes emit infrared light.

As another aspect of an embodiment of a method, the act of regulating can comprise regulating the voltage applied to the diodes to maintain a substantially constant current through the resistor during substantially the entire time that the infrared light emitting diodes emit infrared light.

As yet another aspect of an embodiment of a method, the method can comprise the act of increasing the resistance of the resistor network during at least a portion of the time that audio signals to be transmitted are not being received by the microphone. The act of increasing the resistance can comprise adding resistance to or increasing the effective resistance of the current flow path. One specific method embodiment comprises decoupling a resistor from a parallel combination of at least two resistors in the resistor network to increase the resistance of the resistor network.

DETAILED DESCRIPTION

The description below proceeds with reference to several embodiments. These are exemplary embodiments only and are not to be viewed as limiting the scope of the invention disclosed herein.

Figure 1:
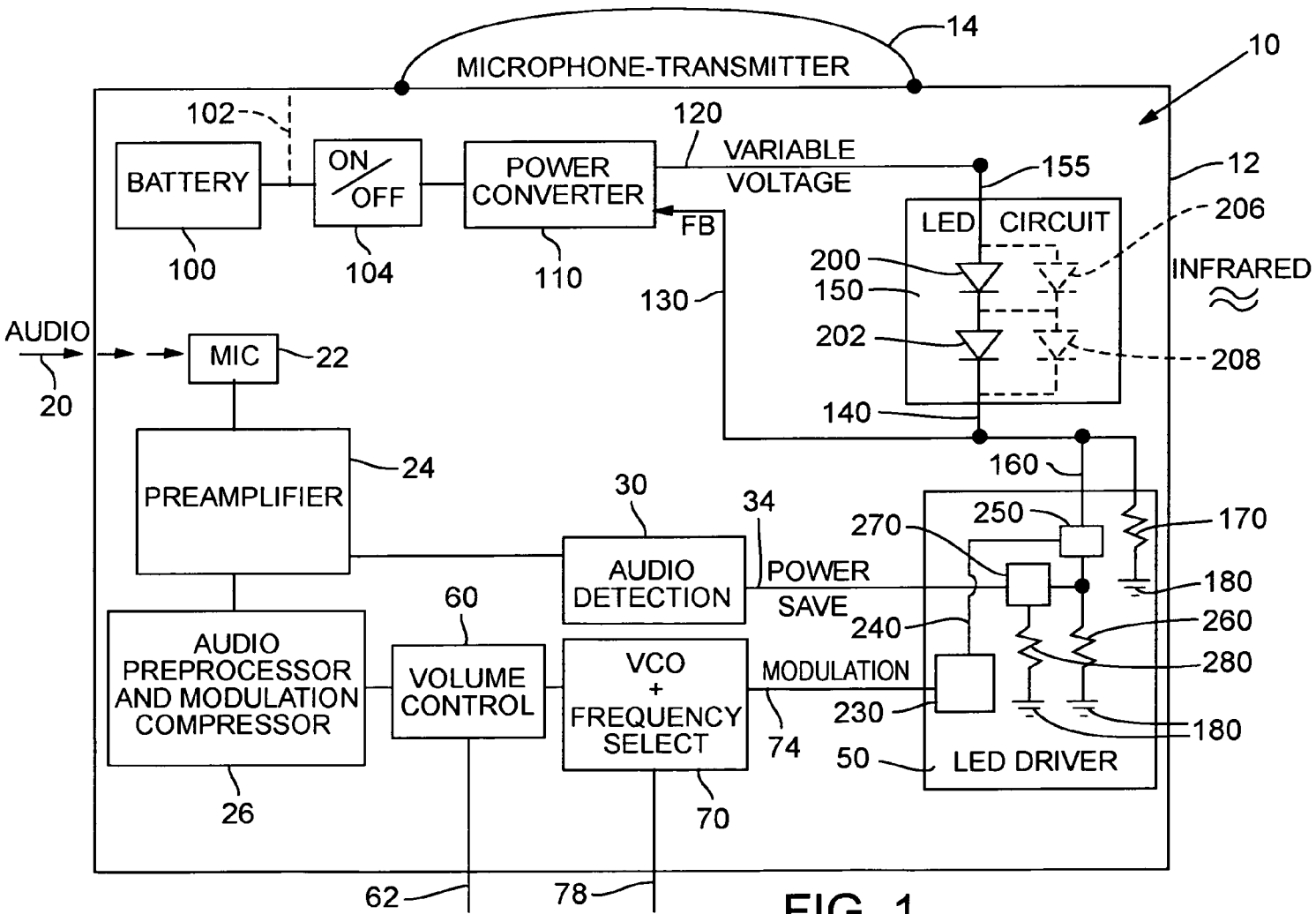
FIG. 1 is a block diagram of a microphone/infrared signal transmission circuit in accordance with one embodiment of the disclosure.

With reference to FIG. 1, a microphone 10 is illustrated and is desirably portable with a housing 12. The microphone can be worn or carried by a user such as hung by the user's neck utilizing a cord, schematically indicated at 14.

Audio (represented by arrows 20) from, for example, a speaker wearing the microphone is delivered to a microphone 22. Any suitable microphone can be used, such as, for example, a Panasonic Model WM-55A103 microphone. The audio signals can be pre-amplified by a pre-amplifier circuit 24 and can be processed by an audio preprocessor and modulation compressor circuit 26. Audio detection circuitry 30 can be included and can respond to signals from pre-amplifier 24 to provide a power save signal at an output 34. The power save signal can be at a first level in this embodiment during at least portions of the time, and more desirably during the entire time, that audio is being detected for transmission by the microphone. In contrast, the power save signal and output 34 can be at a second level, different from the first level, during at least portions of the time that audio for transmission is not being detected. More desirably, the power save signal is at this second level during the entire time that audio for transmission is not being detected. A light emitting diode driver circuit 50 is responsive to the power save signal to reduce power consumption at times when the power save signal is at the second or audio non-detection level.

Signals from the audio preprocessor 26 can be fed to a volume control circuit 60 which can operate, for example, in response to control signals via a push button or other actuator 62 operated by the user, to control the volume of the audio signals. The audio signals can be fed to a voltage controlled oscillator 70 operating at a carrier frequency to provide a frequency modulated or modulation signal at an output 74 corresponding to the detected audio signals. An input, such as indicated at 78, can be used to select the carrier frequency of the voltage controlled oscillator 70. For example, if multiple microphones are being used in a room, a different carrier frequency can be selected for each microphone so that a receiver can distinguish between the signals being received from the various microphones in the room.

The pre-amplifier, audio preprocessor and modulation compressor, volume control circuitry, audio detection circuitry and voltage controlled oscillator with frequency selection circuitry can each be implemented in a conventional manner such as by using commercially available digital components. For example, portions of the ST Microelectronics Hi-Fi stereo/mono infrared transmitter and stereo sub-carrier generator circuit (Model TSH512) can be used for the microphone pre-amplifier circuit, the voltage controlled oscillator and frequency selection circuit, and the audio detection and power save signal generation circuit (e.g., the power save signal being taken from the VOX_mute output of this particular circuit although the power save signal is desirably modified to vary from low voltage levels to high voltage levels with the low voltage level being above 0 volts. An exemplary carrier frequency for one microphone is two megahertz. The pre-amplifier circuit 24 is desirably provided to pre-amplify the microphone output to a level appropriate for the input to the audio preprocessor and modulation compressor circuit 26. The audio preprocessor and compressor circuit can be also implemented using a commercially available integrated circuit component, such as a model SSM2167 circuit available from Analog Devices. The volume control circuit can be implemented utilizing a digital potentiometer, for example, that can be stepped up or down, for example 16 steps up or 16 steps down. A push button can be held down by the user with the circuit automatically incrementing/decrementing until the button is released. A desirable adjustment range in one example is set to +/−6 db to accommodate most situations in a classroom. The limited range of adjustment minimizes problems associated with feedback or no gain. The volume can be reset to a center range upon a power on cycle.

Referring again to FIG. 1, desirably the microphone is portable and battery powered. For example, a battery 100, which can comprise a single AA battery, can be used. The circuiting of FIG. 1 has a battery life that is about the same as the battery life of the prior art LT 71 microphone discussed above which used two AA batteries. A charging port 102 can be provided for connection to a charging circuit, not shown, for recharging the battery in the event a rechargeable battery is used. As an alternative, if the microphone is being used in a situation where portability is not needed, a power supply/charger circuit can be connected to port 102 while the microphone is in use. An on/off switch 104 can also be provided which, for example, can be a push on/push off power switch. Power is delivered to a power converter 110 when switch 104 is in the on position. Power converter 110 provides a variable voltage output voltage that is as explained in greater detail below. As a specific example, power converter 110 can produce an output variable from 1.2 volts to 3.6 volts. Power converter 110 can be implementing utilizing a commercially available integrated circuit, such as a Model TPS61020 power converter circuit from Texas Instruments.

The variable voltage output from power converter 110 is shown at 120 in FIG. 1. In the illustrated embodiment, a feedback voltage path 130 is shown coupled from an output 140 of an infrared light emitting diode circuit 150 to a feedback input (FB) to power converter 110. The variable voltage output 120 is coupled to an input 155 to the infrared light emitting diode circuit 150. An input 160 to the light emitting diode driver circuit 50 is also shown coupled to feedback path 130 and thus to the output 140 of the light emitting diode circuit 150. In this description, the term "coupled to" means both the direct connection of two elements to one another as well as indirect connection of such elements to one another through one or more additional elements. A resistor 170 is also shown coupling input 160 to the electrical ground potential 180.

The illustrated LED driver circuit 50 comprises a resistor network of at least one resistor and more desirably plural resistors. When the LED driver circuit 50 is conducting, a current flow path is provided through the LED diode circuit 150 and through the LED driver circuit 50 to ground 180. The feedback path 130 provides a signal corresponding to the voltage at input 160 to the LED driver circuit and correspondingly to the current flowing through the LED driver circuit. The power converter is operable in this example to vary the voltage at output 120 (Vcc) to maintain the voltage at location 160 constant to thereby maintain a substantially constant current through the resistance circuit (in this case, the resistance circuit through the LED driver circuit 50) during at least a portion of the time that infrared light is being emitted from the infrared diodes of the infrared diode circuit 150 and more desirably during the entire time that such infrared light is being emitted. The forward voltage across the infrared light emitting diodes of the diode circuit can differ depending upon the forward current flow. By automatically adjusting the voltage supplied to the diode circuit as explained above, the total power can be minimized and thus battery life extended. The current flowing through the LED driver circuit 50 is then modulated by the frequency modulated carrier signal to provide infrared light from the diodes of circuit 150 that corresponding to the detected audio for transmission to a receiver.

The light emitting diode circuit 150 desirably comprises at least two light emitting diodes that can, for example, be oriented in a skewed relationship (e.g., perpendicularly to one another) to better enhance the transmission of light to a receiver. For example, the LED circuit 150 can comprise a first infrared emitting light diode 200 in series with a second light emitting diode 202 with the cathode of diode 200 being coupled to or connected to the anode of diode 202 in this example. The anode of diode is 200 is coupled to or connected to the input 155 to the diode circuit 150 while the cathode of diode 202 is coupled to or connected to the output 140 of the light emitting diode circuit. Alternatively, and less desirably, the two diodes 200, 202 can be connected in parallel with one another. By connecting the diodes in series, lower losses result from current flowing through the light emitting diodes. As another optional alternative, the diodes 200, 202 can comprise a first set of infrared light emitting diodes in series with one another in a first circuit branch of the light emitting diode circuit. In addition, in the example of FIG. 1, the diode circuit can comprise a second set of diodes, in this case comprising two diodes 206, 208, in series with one another and in a second circuit branch that is parallel to the first circuit branch. In this example, the anode of diode 206 is coupled to or connected to input 155, the cathode of diode 206 is connected to or coupled to the anode of diode 208, and the cathode of diode 208 is coupled to or connected to the output 160. In addition, in this example the cathodes of the diodes 200, 206 are coupled together. The parallel branches of diodes interconnected in this manner limit the amount of power dissipated in each individual diode.

Figure 2:
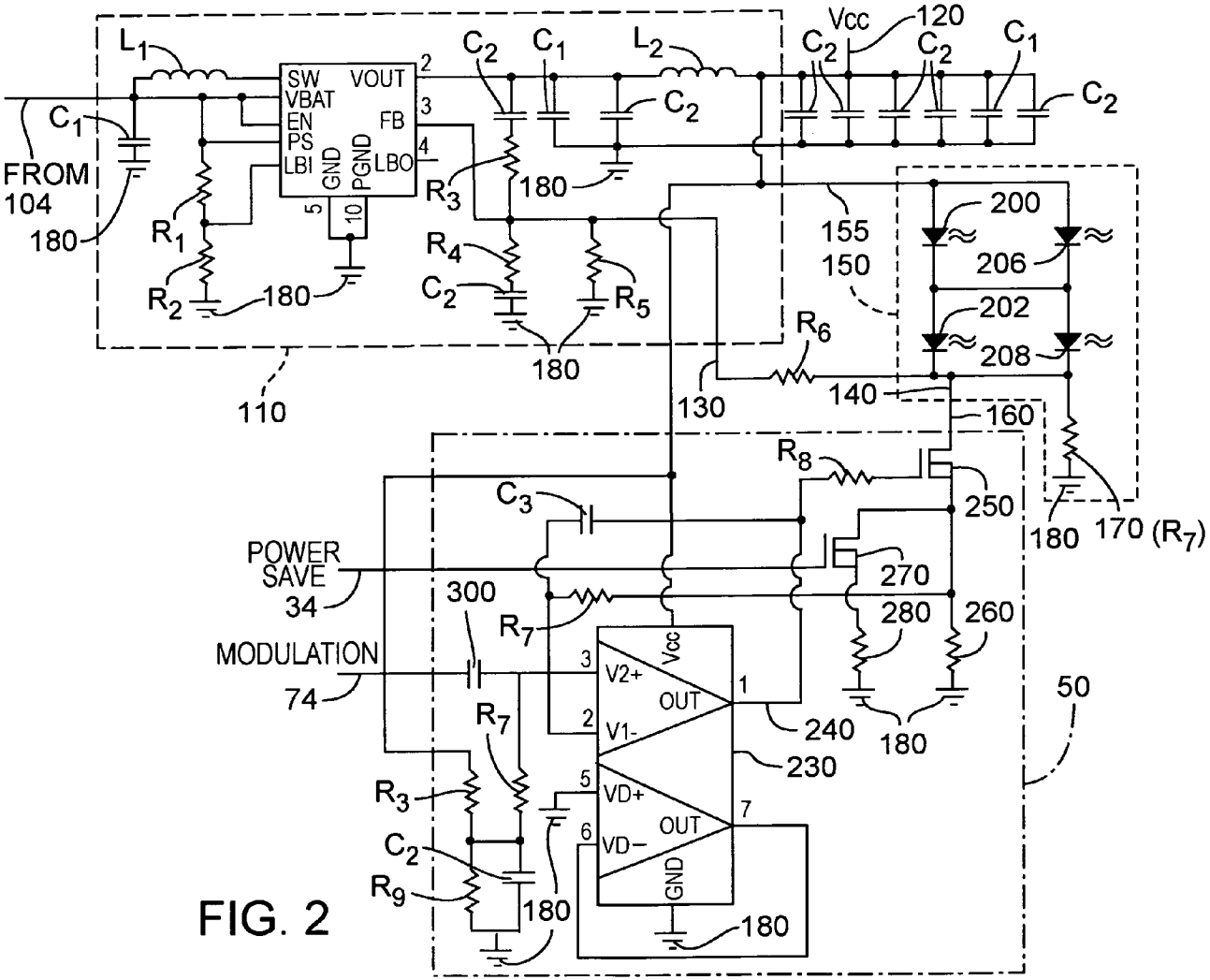
FIG. 2 is a more detailed diagram of a portion of the microphone circuit of FIG. 1.

In FIG. 1, the frequency modulated signal at output 74 is coupled to a switch driver circuit 230 of LED driver circuit 50. The switch driver circuit can comprise a conventional integrated circuit, such as a combined amplifier/driver circuit with a Model TSH72 integrated circuit from STMicroelectronics being a specific example. The output of circuit 230 operates a switch 250 to turn on and off the switch. When on, a current flow path is provided through a resistor 260 to ground. Although other switches can be used, a specific exemplary switch is a MOSFET transistor switch so as to minimize DC losses in the system. As can be seen in FIG. 2, if switch 250 is turned on and the current through resistor 260 were to rise, the voltage at the output switch 250 would increase. This increased voltage would be applied via resister $R_7$ to the V1-input of the upper amplifier of circuit 230, causing a reduction in the voltage at output 240 that is applied via resistor $R_8$ to switch 250. This reduces the voltage at the output of switch 250 and at resistor 260 and reduces the current through the resistor so that it does not increase, thereby maintaining a substantially constant current through the resistance circuit. The opposite change is caused to occur if the voltage across voltage 260 were to drop (the reduction in voltage being applied to the V1-input, the output voltage at 240 increases and is applied via resistor $R_8$ to switch 250, causing the voltage at the output of switch 250 to increase to raise the voltage at resistor 260, thereby maintaining a substantially constant current is across resistor 260. In an embodiment in which the power save feature is provided, the power save output 34 is coupled to a second switch 270, which can be like the switch 250. The power save signal is operated to selectively reduce the power consumed by the microphone during at least portions of the time, and more desirably during the entire time, that audio is being detected for transmission. That is, when audio is not being detected for transmission, or during at least portions of such time, the power save signal is at a level which turns on the switch 270. In such a case, the resistor 280 is coupled to the resistor network of the LED driver circuit to reduce the overall resistance of the LED driver circuit. In this specific example, under these conditions a resistor 280 is coupled in parallel with the resistor 260, resulting in a higher current through the LED driver circuit and through the diode circuit. In contrast, during at least portions of the time, and more desirably during the entire time, that audio is not being detected for transmission, the power save signal 34 is at a level that turns off the switch 270. As a result, the resistance of the LED driver circuit is increased (in this example because resistor 280 is no longer coupled in parallel with the resistor 260) to thereby reduce the current through the LED driver circuit and power consumption. Alternatively, a circuit that adds resistance in series with resistor 260 under no audio detection conditions can be used.

FIG. 2 illustrates a specific exemplary implementation of the power converter 110, LED circuit 150 and LED driver circuit 50 that can be utilized in the embodiment of FIG. 1. In the embodiment of FIG. 2, two sets of diodes 200, 202 and 206, 208 are shown included in the circuit. Also, the power converter in this example can be implemented using a commercially available integrated circuit, such as a Model TPS61020 power converter circuit from Texas Instruments. In addition, the circuit 230 can comprise an LED bias set point driver and signal amplifier circuit such as a Model TSH82 integrated circuit from ST Microelectronics. In the example shown in FIG. 2, the DC current flow through the diodes of diode circuit 150 is established by the DC voltage across resistor 260 (which can, for example, be 1.6 ohms) in parallel with the resistor 280 (which can, for example, can be 3.3 ohms). In contrast, in a low power mode, the resistor 280 is decoupled from being in parallel with the resistor 260 to thereby increase the resistance of the current flow path through the LED driver circuit 50. The power save signal at 34 controls this DC voltage level in this particular example. Although desirable, the power save feature can be eliminated. The frequency modulation or modulated signal from input 74 is delivered through a capacitor 300 (for example a 470 picofarad capacitor) to an input of circuit 230.

Although the various components in the circuit of FIG. 2 can be assigned different values, including the values of components mentioned above, Table 1 below sets forth an exemplary set of values for the inductors, capacitors and resistors of FIG. 2 that have not previously been set forth in examples described above. In FIG. 2, components with the same value have been identified by the same letter and suffix (e.g., all capacitors with a 0.1μ f value are designated $c_1$). Although not shown in FIG. 2, the Vcc signal can also be used to drive another diode (such as a blue LED) to indicate power is on. Also, the Vcc signal can be coupled through yet another diode (for example, a red LED) to the LBO input of the power converter circuit so as to turn on and indicate low battery conditions to a user of the device in the event of low battery power. Although less desirable, hardwired discrete components can be used to accomplish the functions described above. Also, microprocessors as well as other integrated circuits can also be used to implement the circuitry described above.

TABLE 1

| | |
|---|---|
| $L_1$ = | 7.3 μh |
| $L_2$ = | 10.0 μh |
| $c_1$ = | 10 μf |
| $c_2$ = | 0.1 μf |
| $c_3$ = | 47 pf |
| $R_1$ = | 13 kΩ |
| $R_2$ = | 10 kΩ |
| $R_3$ = | 100 kΩ |
| $R_4$ = | 15 kΩ |
| $R_5$ = | 1 Meg Ω |
| $R_6$ = | 475 kΩ |
| $R_7$ = | 1 kΩ |
| $R_8$ = | 50 Ω |
| $R_9$ = | 2.2 Ω |

Having illustrated and described the principles of my invention with reference to a number of illustrative embodiments, it should be apparent to those of ordinary skill in the art that the technology may be modified in arrangement and detail without departing from the inventive principles disclosed herein. I claim all modifications and variations thereof that fall within the scope of the following claims.

I claim:

1. A microphone circuit for transmitting infrared light in response to frequency modulated signals, the frequency modulated signals corresponding to audio signals received by a microphone coupled to the microphone circuit, the microphone circuit comprising:

a current flow path comprising an infrared diode circuit comprising at least two infrared light emitting diodes;

the current flow path also comprising a switch responsive to the frequency modulated signals to control the flow of current through the current flow path in response to the frequency modulated signals to thereby control the flow of current through the infrared diode circuit and the emission of infrared light from the infrared diodes so as to correspond to the audio signals;

the current flow path further comprising a resistance circuit comprising at least one resistor;

a light emitting diode driver circuit coupled to the switch and to the resistance circuit and operable to drive the switch;

a voltage source coupled to the infrared diode circuit; and a voltage regulator operable to vary the voltage of the voltage source; the voltage regulator comprising a feedback circuit coupled to the current flow path to provide a feedback signal corresponding to the current in the current flow path, the voltage regulator being operable to vary the voltage of the voltage source to maintain a substantially constant current through the resistance circuit during at least a portion of the time that infrared light is emitted from the infrared diodes of the infrared diode circuit.

2. A microphone circuit according to claim 1 wherein the infrared diode circuit comprises at least a first diode set comprising first and second infrared light emitting diodes coupled together in series and between the voltage source and the switch.

3. A microphone circuit according to claim 2 comprising at least a second diode set comprising at least third and fourth infrared light emitting diodes coupled together in series and between the voltage source and switch, the first diode set being in parallel with the second diode set, the outputs of the first and third diodes being interconnected, and the outputs of the second and fourth diodes being interconnected.

4. A microphone circuit according to claim 1 wherein the resistance of the resistance circuit is responsive to a power save signal, the resistance of the resistance circuit being at first magnitude in response to a power save signal of a first value, the resistance of the resistance circuit being of a second magnitude that is higher than the first magnitude in response to a power save signal of a second value different from the first value, the power save signal being at the second value at least during portions of the time that audio signals are not being received by the microphone for transmission.

5. A microphone circuit according to claim 4 wherein the resistance circuit comprises at least a first resistor and a second resistor and further comprises a resistance adjusting switch responsive to the power save signal, the resistance adjusting switch being operable to couple the second resistor of the resistance circuit in parallel with the first resistor of the resistance circuit to thereby reduce the magnitude of the resistance of the resistance circuit when the power save signal is at the first value, and the resistance adjusting switch being operable to decouple the second resistor from being in parallel with the first resistor so as to increase the magnitude of the resistance of the resistance circuit when the power save signal is at the second value, the power save signal only being at the second value when no audio signals are being received for transmission.

6. A microphone circuit for transmitting infrared light in response to frequency modulated signals, the frequency modulated signals corresponding to audio signals received by a microphone coupled to the microphone circuit, the microphone circuit comprising:

an infrared diode circuit comprising a diode circuit input and a diode circuit output and at least two infrared light emitting diodes coupled together and positioned in a diode circuit current flow path between the diode circuit input and diode circuit output, the infrared light emitting diodes emitting infrared light in response to current flowing in the diode circuit current flow path;

an adjustable voltage source coupled to the diode circuit input;

a switch circuit comprising a switch input coupled to the diode circuit output and a switch output, the switch circuit also comprising a switch in a switch current flow path between the switch input and switch output, the switch comprising a control input for receiving the frequency modulated signals to control the flow of current through the switch current flow path in response to the frequency modulated signals to thereby control the flow of current through the diode circuit current flow path and the emission of infrared light from the infrared light emitting diodes to correspond to the audio signals;

a voltage control circuit operable to adjust the voltage of the voltage source so as to maintain the voltage at the diode circuit output at a first level as the switch operates, the voltage control circuit comprising a feedback circuit coupled to the diode circuit output and providing a feedback signal, the voltage control circuit adjusting the voltage of the voltage source in response to the feedback signal; and a resistance circuit comprising a resistor circuit current flow path from the switch output to electrical ground potential and at least one resistor in the resistor circuit current flow path.

7. A microphone circuit according to claim 6 wherein the infrared light emitting diodes comprise first and second infrared light emitting diodes in series with one another.

8. A microphone circuit according to claim 7 wherein the infrared light emitting diodes comprise at least a first diode set of at least first and second infrared light emitting diodes in series with one another and a second diode set of at least third and fourth infrared light emitting diodes in series with one another, the diodes of the first diode set being in parallel with the diodes of the second diode set.

9. A microphone circuit according to claim 8 wherein there are only two sets of two diodes and wherein the anodes and cathodes of the first and third diodes are interconnected and wherein the anodes and cathodes of the second and fourth diodes are interconnected.

10. A microphone circuit according to claim 6 wherein the resistance of the resistance circuit is adjustable in response to the presence of audio signals to be transmitted.

11. A microphone circuit according to claim 6 wherein the resistance of the resistance circuit is responsive to a power save signal with the resistance of the resistance circuit being of a first magnitude in response to power save signal of a first value, the resistance of the resistance circuit being of a second magnitude which is higher than the first magnitude when the power save signal is at a second value different from the first value, the power save signal being set at the second value at least during portions of the time that audio signals are not being received by the microphone for transmission.

12. A microphone circuit according to claim 11 wherein the resistance circuit comprises at least two resistors with at least one of the two resistors being selectively coupled to the resistor circuit current flow path to vary the resistance of the resistance circuit in response to the power save signal.

13. A microphone circuit according to claim 11 wherein the resistance circuit comprises at least a first resistor and a second resistor and further comprises a resistance adjusting switch responsive to the power save signal, the resistance adjusting switch being operable to couple the second resistor of the resistance circuit in parallel with the first resistor of the resistance circuit to thereby reduce the magnitude of the resistance of the resistance circuit when the power save signal is at the first value, and the resistance adjusting switch being operable to decouple the second resistor from being in parallel with the first resistor so as to increase the magnitude of the resistance of the resistance circuit when the power save signal is at the second value, the power save signal only being at the second value when no audio signals are being received for transmission.

14. A microphone circuit according to claim 6 wherein the resistance circuit comprises at least two resistors with at least one of the two resistors being selectively coupled to the resistor circuit current flow path to vary the resistance of the resistance circuit.

15. A method of transmitting infrared light in response to frequency modulated signals corresponding to audio signals received by a microphone, the method comprising:

selectively passing current through infrared light emitting diodes so as to cause the infrared light emitting diodes to emit infrared light in response to current flowing through the diodes;

operating a switch in response to the frequency modulated signals to control the flow of current through the switch and through the infrared diodes to thereby control the emission of the infrared light from the infrared light emitting diodes to correspond to audio signals received by the microphone;

passing current from the switch through a resistor network comprising at least one resistor;

providing a feedback signal to a voltage source, the feedback signal corresponding to the voltage at a location between an output of the light emitting diodes and an input to the switch; and maintaining a substantially constant current through the resistor network during at least a portion of the time that the infrared diodes emit infrared light.

16. A method according to claim 15 wherein the act of regulating comprises regulating the voltage applied to the diodes to maintain a substantially constant current through the resistor during substantially the entire time that the infrared light emitting diodes emit infrared light.

17. A method according to claim 15 comprising the act of increasing the resistance of the resistor network during at least a portion of the time that audio signals to be transmitted are not being received by the microphone.

18. A method according to claim 17 wherein the act of increasing the resistance comprises decoupling a resistor from a parallel combination of at least two resistors in the resistor network.

19. A microphone circuit for transmitting infrared light in response to frequency modulated signals, the frequency modulated signals corresponding to audio signals received by a microphone coupled to the microphone circuit, the microphone circuit comprising:

a current flow path comprising an infrared diode circuit comprising plural infrared light emitting diodes, the infrared diode current comprising an infrared diode circuit input and an infrared diode circuit output;

the current flow path also comprising a transistor switch responsive to the frequency modulated signals to control the flow of current through the current flow path in response to the frequency modulated signals to thereby control the flow of current through the infrared diode circuit to the infrared diode circuit output and the emission of infrared light from the infrared diodes so as to correspond to the audio signals;

the current flow path further comprising a resistance circuit coupled to the infrared diode circuit output and comprising at least one resistor;

a voltage source coupled to the infrared diode circuit input to provide current through the infrared light emitting diodes;

a voltage regulator operable to vary the voltage of the voltage source, a feedback circuit coupled to the infrared diode output and to the voltage regulator, the voltage regulator being operable in response to feedback signals in the feedback circuit to vary the voltage of the voltage source so as to provide a substantially constant current through the infrared light emitting diodes; and the voltage regulator being operable so as to maintain a substantially constant current through the resistance circuit during emission of infrared light from the infrared diodes of the infrared diode circuit;

wherein the infrared diode circuit comprises at least a first diode set comprising first and second infrared light emitting diodes coupled together in series and between the voltage source and the switch, the infrared diode circuit also comprising at least a second diode set comprising at least third and fourth infrared light emitting diodes coupled together in series and between the voltage source and switch, the first diode set being in parallel with the second diode set, and the outputs of the first and third diodes being interconnected, and the outputs of the second and fourth diodes being interconnected;

wherein the resistance of the resistance circuit is responsive to a power save signal, the resistance of the resistance circuit being at first magnitude in response to a power save signal of a first value, the resistance of the resistance circuit being of a second magnitude that is higher than the first magnitude in response to a power save signal at a second value different from the first value, the power save signal being at the second value at least during portions of the time that audio signals are not being received by the microphone for transmission; and wherein the resistance circuit comprises at least a first resistor and a second resistor and further comprises a resistance adjusting switch responsive to the power save signal, the resistance adjusting switch being operable to couple the second resistor of the resistance circuit in parallel with the first resistor of the resistance circuit to thereby reduce the magnitude of the resistance of the resistance circuit when the power save signal is at the first value, and the resistance adjusting switch being operable to decouple the second resistor from being in parallel with the first resistor so as to increase the magnitude of the resistance of the resistance circuit when the power save signal is at the second value.

20. A microphone circuit for transmitting infrared light in response to frequency modulated signals, the frequency modulated signals corresponding to audio signals received by a microphone coupled to the microphone circuit, the microphone circuit comprising:

a current flow path comprising an infrared diode circuit comprising at least two infrared light emitting diodes;

the current flow path also comprising a switch responsive to the frequency modulated signals to control the flow of current through the current flow path in response to the frequency modulated signals to thereby control the flow of current through the infrared diode circuit and the emission of infrared light from the infrared diodes so as to correspond to the audio signals;

the current flow path further comprising a resistance circuit comprising at least one resistor;

a voltage source coupled to the infrared diode circuit;

a voltage regulator operable to vary the voltage of the voltage source; and a light emitting diode driver circuit coupled to the switch and to the resistance circuit, the voltage regulator being operable to maintain a substantially constant current through the resistance circuit during at least a portion of the time that infrared light is emitted from the infrared diodes of the infrared diode circuit; and wherein the infrared diode circuit comprises an infrared diode circuit input and an infrared diode circuit outlet output, the switch comprising a switch input coupled to the infrared diode circuit output and a switch output coupled to the resistance circuit, the voltage source being coupled to the input of the infrared diode circuit, the voltage regulator comprising a feedback current path coupled to the switch input to provide a feedback signal corresponding to the voltage at the switch input.

* * * * *